US005375807A

United States Patent [19]

Claas

[11] Patent Number: 5,375,807

[45] Date of Patent: Dec. 27, 1994

[54] TREE STAND

[76] Inventor: Paul Claas, 3731 Shiloh Rd., DeForest, Wis. 53532

[21] Appl. No.: 151,416

[22] Filed: Nov. 12, 1993

Related U.S. Application Data

[63] Continuation-in-part of Ser. No. 905,003, Jun. 26, 1992, abandoned.

[51] Int. Cl.[5] ..... F16M 13/00

[52] U.S. Cl. ..... 248/514; 248/523; 47/40.5

[58] Field of Search ..... 248/519, 523, 520, 574, 248/515, 284; 47/40.5

[56] References Cited

U.S. PATENT DOCUMENTS

| | | | |
|---|---|---|---|
| 2,008,233 | 7/1935 | Walthers | 248/514 X |
| 2,746,700 | 5/1956 | Barbera | 248/44 |
| 2,893,668 | 7/1959 | Applegate | 248/44 |
| 2,904,291 | 9/1959 | Harbes et al. | 47/40.5 X |
| 2,997,264 | 8/1961 | Zelenitz | 248/44 |
| 3,033,505 | 5/1962 | Brown | 248/44 |
| 3,142,464 | 7/1964 | Zelenitz | 248/44 |
| 3,143,324 | 8/1964 | Kappelman | 248/44 |
| 3,272,462 | 9/1966 | Apple | 248/44 |
| 3,661,349 | 5/1972 | DeVries | 47/40.5 |
| 3,801,053 | 4/1974 | Laute | 47/40.5 |
| 4,126,963 | 11/1978 | Dunbar | 47/40.5 |
| 4,408,415 | 10/1983 | Davis et al. | 47/40.5 |
| 4,585,201 | 4/1986 | Pursell | 248/523 |
| 4,601,399 | 7/1986 | Brenteson | 211/60.1 |
| 4,610,356 | 9/1986 | Porter et al. | 206/423 |
| 4,699,347 | 10/1987 | Kuhnley | 248/516 |
| 4,762,454 | 8/1988 | Davis | 411/446 |

FOREIGN PATENT DOCUMENTS

| | | | |
|---|---|---|---|
| 728806 | 4/1932 | France | 248/514 |

*Primary Examiner*—Blair M. Johnson

*Attorney, Agent, or Firm*—Michael, Best & Friedrich

[57] ABSTRACT

A stand for supporting a tree having a bore, the stand including a base adapted to be supported on a horizontal surface; a frame supported by the base for pivotal movement about a first generally horizontally extending pivot axis spaced above the horizontal surface, the frame having a first portion and a second portion supported by the first portion for pivotable movement about a second generally horizontally extending pivot axis, the second portion of the frame having a post extending below the second pivot axis and being adapted to be housed by the bore in the tree; a mechanism for moving the frame about the first pivot axis relative to the base; and a mechanism for moving the frame about the second pivot axis relative to the second portion of the frame.

20 Claims, 4 Drawing Sheets

TREE STAND

This application is a continuation-in-part of application Ser. No. 07/905,003 filed Jun. 26, 1992, now abandoned.

BACKGROUND OF THE INVENTION

The invention relates generally to stands for supporting trees, and particularly to adjustable stands for supporting trees.

SUMMARY OF THE INVENTION

It is generally known to display a tree by using a tree stand including a post extending into a bore in the tree's trunk. A tree stand having a post upon which a tree can be mounted provides advantage by supporting the weight of the tree below while also providing lateral support against tipping. One of the problems that can be encountered in supporting a tree on such a tree stand is that the bore drilled into the tree trunk can be skewed so that the tree may not stand straight up when mounted on a vertically extending post. This problem can be readily apparent in taller trees where even a slight deviation the angle of the bore relative to the tree trunk can result in a noticeable tilt of the tree.

Another problem presented by some tree stands is that the tree either cannot be supported inside a watering bowl or the components of the stand are subjected to rusting or corrosion caused by water leaking from a watering bowl. Such rusting or corrosion can render inoperable otherwise adjustable or moveable components of the tree stand.

In view of these and other considerations, the invention provides a stand for supporting a tree having a bore, the stand including a base adapted to be supported on a horizontal surface; a frame supported by the base for pivotal movement about a first generally horizontally extending pivot axis spaced above the horizontal surface, the frame having a first portion and a second portion supported by the first portion for pivotable movement about a second generally horizontally extending pivot axis, the second portion of the frame having a post extending below the second pivot axis and being adapted to be housed by the bore in the tree; first adjustment means for moving the frame about the first pivot axis relative to the base; and second adjustment means for moving the first portion of the frame about the second pivot axis relative to the second portion of the frame.

In one embodiment, the invention provides a stand for supporting a tree having therein a bore and for supporting a container of water, the stand including a base; a frame supported by the base for pivotal movement about a first generally horizontally extending pivot axis, the frame having a first portion and a second portion supported by the first portion for pivotable movement about a second generally horizontally extending pivot axis, the second portion of the frame having a post extending below the second pivot axis and being adapted to be housed by the bore in the tree; and a stand fixed to the base for supporting the container of water in a position surrounding the post, the stand being movable relative to the base along a vertically extending axis independent of the position of the post.

In one embodiment, the invention provides a stand for supporting a tree in a container of water, the tree having therein a bore, the stand including a base adapted to be supported on a horizontal surface; a frame supported by the base for pivotal movement about a first generally horizontally extending pivot axis spaced above the horizontal surface, the frame having a first portion and a second portion supported by the first portion for pivotable movement about a second generally horizontally extending pivot axis; first adjustment means located laterally of the container of water for moving the frame about the first pivot axis relative to the base; second adjustment means located laterally of the container of water for moving the first portion of the frame about the second pivot axis relative to the second portion of the frame; and a post extending from the frame and being adapted to be housed by the bore in the tree and to support the tree so that at least a portion of the tree extends into surrounded relation to the container of water.

One of the features of the tree stand is the provision of a supporting post on an adjustable frame. The frame is independently adjustable about two perpendicular axes so that the post, and the tree mounted on the post, can be moved into the most stable position. Also, the tree stand includes adjustment mechanisms for properly orienting the frame without the need for otherwise supporting the tree. The provision of the adjustment mechanisms affords an individual the ability to mount the tree on the stand and to adjust the frame without the aid of another.

Various other features and advantages of the invention will become apparent to those skilled in the art upon review of the following detailed description, claims and drawings.

Figure 1:
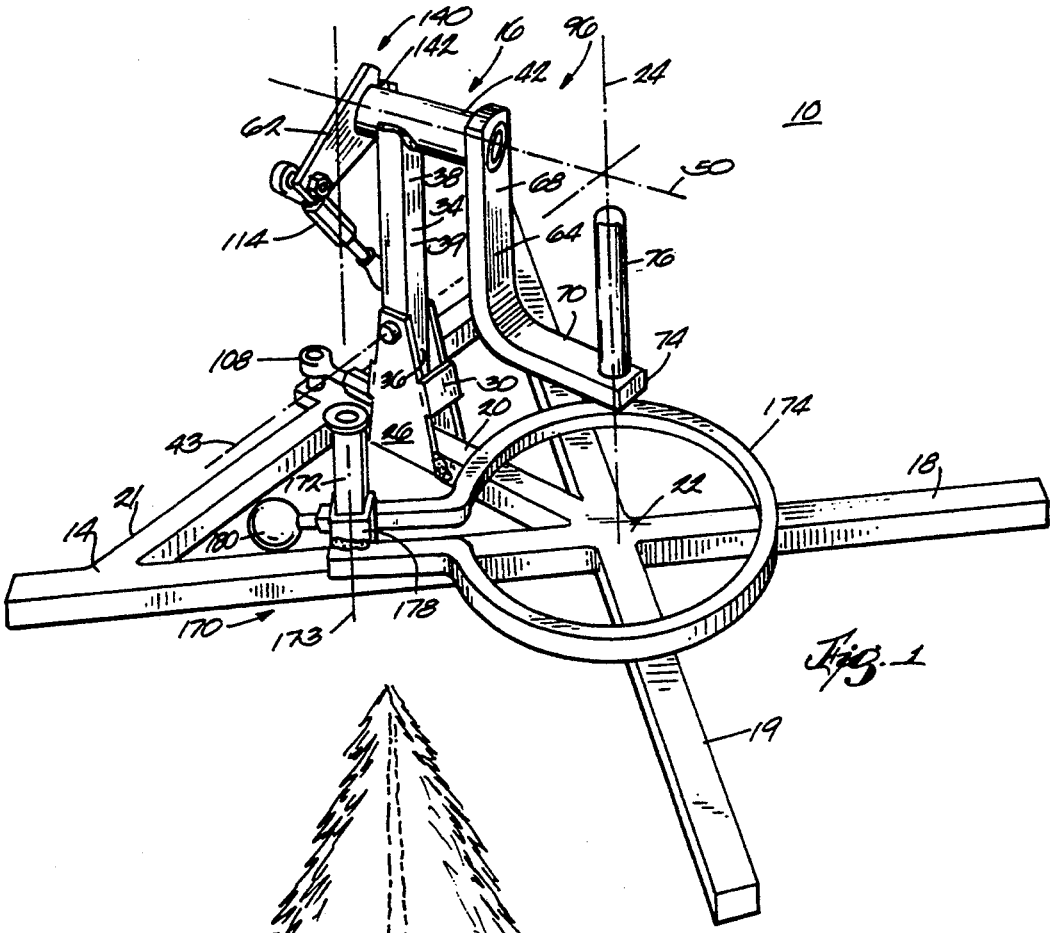
FIG. 1 is a perspective view of a stand embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 2:
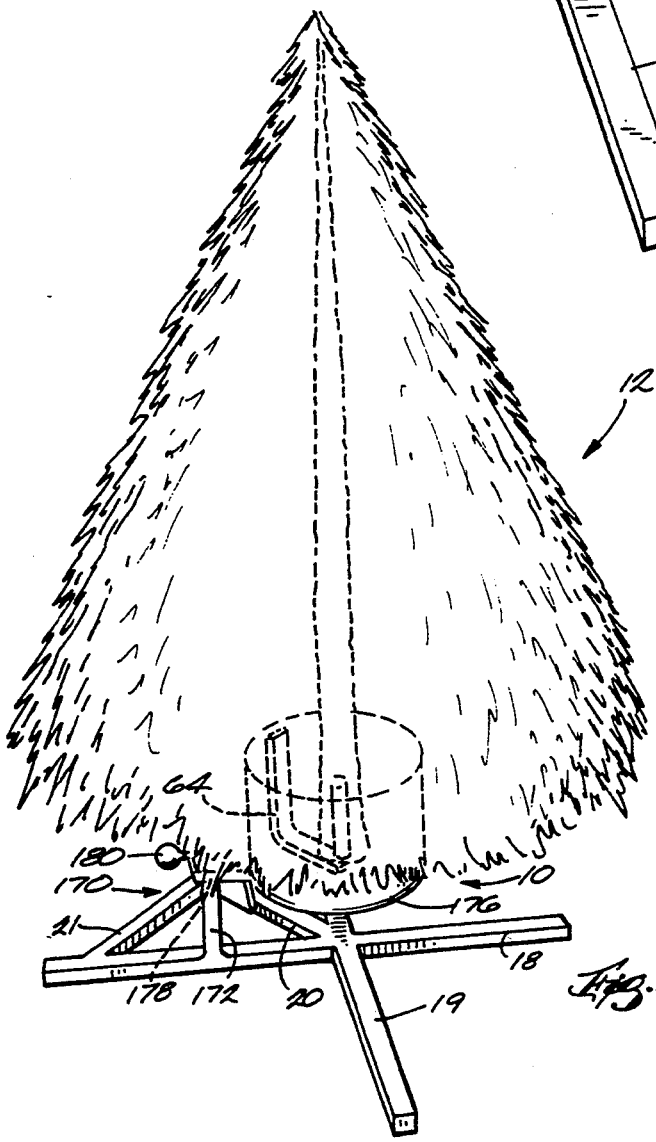
FIG. 2 is a perspective view of the stand shown in FIG. 1 supporting a tree and a watering bowl.
Figure 4:
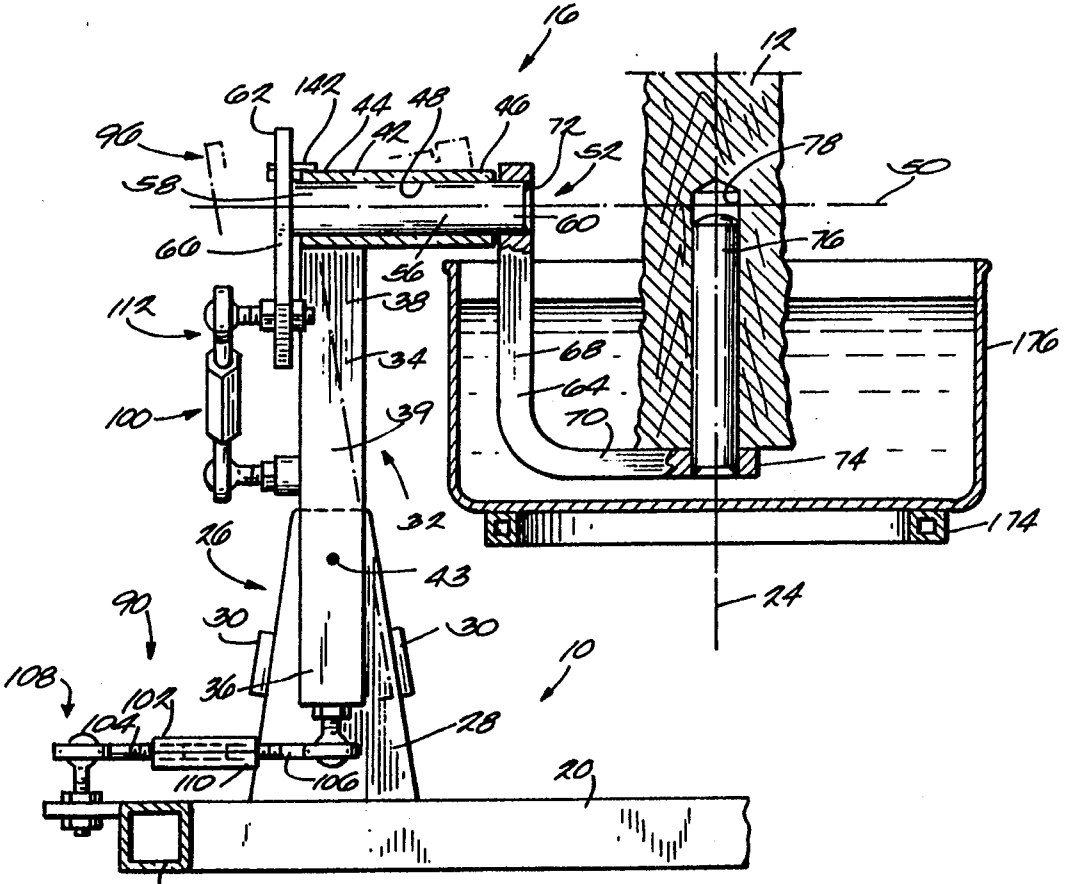
FIG. 4 is a cross-sectional view taken generally along line 4—4 in FIG. 3 with some portions of the stand broken away for illustration.
Figure 3:
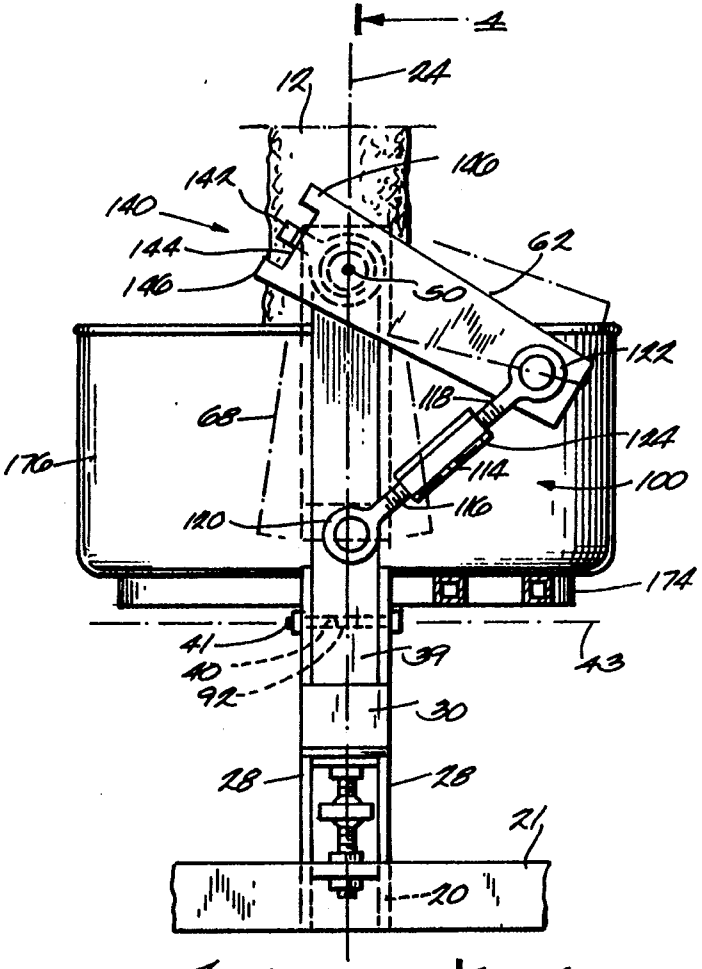
FIG. 3 is an elevational view of a portion of the tree stand shown in FIG. 1.

FIGS. 1–4 illustrate a stand 10 that is well-suited to support a relatively large tree 12, such as a Christmas tree. As shown in FIGS. 2–4, the tree has been cut and has extending a bore which has been drilled into the trunk. The stand 10 also supports a container or watering bowl which can be positioned under the tree 12 so that the trunk extends into a water supply.

In particular, stand 10 includes a relatively wide base 14 that is adapted to be supported on a horizontal surface or floor and that provides a stable platform for an adjustable frame 16. The base 14 includes (FIG. 1) four rigidly connected bars 18, 19, 20 and 21. A first pair of the bars 18, 19 intersect to form an "X" and a pair of bars 20, 21 extend between the first pair of bars 18, 19 to provide additional rigidity to the base 14 and, as explained below, to support the frame 16. The point at which the first pair of bars 18 meet approximates the center of the base 14 and is indicated specifically in FIG. 1 as the point 22 through which a central vertical axis 24 passes. The second pair of bars 20, 21 are connected to form a "T" and are fixed to the first pair of bars 18, 19. One end of bar 20 is fixed to the center of the base 14. The ends of bar 21 are fixed to and respective ends of bars 18, 19 and to the other end of bar 20. The bars 18–21 are preferably welded together and are encapsulated with rubber, plastic or another suitable material that can be relatively easily moved across a floor and that will not rust or corrode in the event the bars become wet.

The base 14 also includes (FIGS. 1, 3 and 4) a frame support 26 extending upwardly from bar 20. In particular, the frame support 26 includes (FIG. 3) a pair of opposed, spaced-apart plates 28 which are fixed to opposite sides of bar 20, and (FIG. 4) a pair of spaced-apart stop plates 30 which extend between and which are fixed to the plates 28. As discussed below, the frame support 26 is located slightly away from the center 22 of the base 14.

The frame 16 includes (FIG. 4) a first portion 32 having a generally vertically extending leg 34 that has a lower end 36, which is located between the frame support plates 28 and the stop plates 30, and an upper end 38 and a midportion 39 located between the ends 36 and 38. The midportion 39 has (FIG. 3) extending therethrough a bore 40 located intermediate the upper and lower ends 38, 36. A pivot pin 41 extends between the plates 28 and through the bore 40 to pivotally support the leg 34 on the base 14. The pivot pin 41 is generally horizontal so that the support leg 34 is pivotably moveable relative to the base 14 about a first generally horizontal first pivot axis 43. Because the pivot pin 41 extends through the midportion 39 of the leg 34, the pivot axis 43 is spaced above the base 14 and above the floor.

The first frame portion 32 also includes (FIG. 1) an external shaft or tube 42 that is fixed to the upper end 38 of the leg 34. The external tube 42 has (FIG. 4) a first end 44 adjacent the upper end 38 of the leg 34 and a second end 46 extending from the leg 34 toward the central axis 24 of the base 14. The external tube 42 defines a bore 48 having a relatively uniform inner diameter and defines a second generally horizontally extending pivot axis 50 that extends generally perpendicular to the leg 34 and that extends perpendicular to the first pivot axis 43. By virtue of the rigid connection of the support leg 34 and the external tube 42, the entire first portion 32 of the frame 16 is pivotable about the first pivot axis 43.

The frame 16 also includes (FIG. 4) a second portion 52 that is supported by the first frame portion 32 and that is pivotable relative thereto about the second pivot axis 50. The second frame portion 52 includes an internal tube or shaft 56 housed by the external tube 42. The internal shaft 56 has an outer diameter which approximates the inner diameter of the external tube bore 48 but provides therebetween adequate clearance to afford free rotation of the internal shaft 56 relative to the external tube 42 about the pivot axis 50. The first end 58 of the internal shaft 56 extends slightly outwardly of the first end 44 of the external tube 42 and the second end 60 of the internal shaft 56 extends outwardly of the second end 46 of the external tube 42.

The second portion 52 of the frame 16 also includes (FIGS. 3 and 4) a pivot bar 62 that is rigidly fixed to the first end 58 of the internal shaft 56. In the stand 10 illustrated in FIGS. 3 and 4, the pivot bar 62 provides a relatively flat surface 66 facing away from the concentrically arranged tubular members 42, 56.

The second frame portion 52 also includes (FIG. 4) an L-shaped leg 64 that is rigidly fixed to the second end 60 of the internal shaft 56. The L-shaped leg 64 has a first portion 68 extending downwardly from the internal shaft 56 generally parallel to the leg 34 and below the second pivot axis 50. The first portion 68 of the leg 64 has extending therethrough a bore 72 which slides over the second end 60 of internal shaft 56 and which is welded or otherwise affixed thereto to provide a rigid connection. The L-shaped leg 64 also has a second portion 70 extending horizontally from the lower end of the first portion 68 of the L-shaped leg 64. The second portion 70 of the leg 64 extends toward the central axis 24 and is generally parallel to and below the second pivot axis 50. The distal end 74 of the L-shaped leg 64 is located approximately over the center 22 of the base 14. Extending upwardly from the end 74 of the L-shaped leg 64 and from below the second pivot axis 50 is a cylindrical support post 76. The post 76 is rigidly fixed to the L-shaped leg 64, extends past the second pivot axis 50, and is adapted to support thereon the trunk of the tree 12 in a manner discussed below.

By virtue of the rigid connection of the pivot bar 62, the internal shaft 56, the L-shaped leg 64, and the support post 76, the entire second portion 52 of the frame 16 is pivotable in common relative to the first portion 32 of the frame 16 about the second pivot axis 50. In addition, the first and second portions 32, 52 of the frame 16 are pivotable in common relative to the base 14 about the first pivot axis 43 because of the perpendicular relationship of the first and second pivot axes 43, 50. For example, as shown by the alternative positions of the frame 16 (one alternative position shown in phantom in FIGS. 3 and 4), as the leg 34 is moved in a direction away from vertical by pivoting the first portion 32 of the frame 16 about the first pivot axis 43 (counterclockwise in FIG. 4), the first portion 68 of the L-shaped leg 64 and the support post 76 also move away from a vertical alignment by rotation about the first pivot axis 43.

From the above discussion, it should also be clear that the second portion 52 of the frame 16 is pivotable about the second pivot axis 50 independent of rotation of the frame 16 about the first pivot axis 43. The above described arrangement of the first and second frame portions 32, 52 provides one such construction for the means supporting the second frame portion 52, though others could be successfully used.

As shown in FIGS. 1 and 4, the second portion 52 of the frame 16 is supported in a cantilevered manner by the first frame portion 32 so that the support post 76 can be aligned with the central axis 24 of the base 14 and so that a tree supported thereon is supported over the center of the base 14 in a generally upright position. In order to support the tree 12 on the post 76, however, the trunk of the tree 12 must be prepared by (FIG. 4) drilling a bore 78 having an inner diameter approximating the outer diameter of the support post 76 into the tree trunk. Once so prepared, the tree 12 can then be mounted on the support post 76 and L-shaped leg 64.

The stand 10 also includes first adjustment means 90 for moving of the frame 16 relative to the base 14. While various suitable constructions for the first adjustment means 90 can be used successfully, in the stand illustrated by FIGS. 1–4, the first adjustment means 90 includes (FIG. 4) a first turnbuckle or retractable link 102 extending between the base 14 and the lower end 36 of the leg 34 for positively moving the frame 16 about the first pivot axis 43 in a controlled manner. In particular, the first turnbuckle 102 includes a first threaded stem 104 that is connected in a conventional manner to the base bar 21 and a second threaded stem 106 that is connected to the lower end 36 of the leg 34. The first and second threaded stems 104, 106 are respectively connected to the base 14 and the lower end 36 of the support leg 34 by swivel connections 108. In the illustrated embodiment, the swivel connections 108 are provided by ball and socket connections but any suitable swivel connection can be employed.

The first turnbuckle 102 also includes a first adjustment nut 110 threadedly engaged with the first and second stems 104, 106. The first and second threaded stems 104, 106 are threaded in opposite directions so that rotation of the first adjustment nut 110 in a first direction will shorten the overall length of the first turnbuckle 102 and rotation of the adjustment nut 110 in the opposite direction will extend the overall length of the first turnbuckle 102. When the first turnbuckle 102 is extended, the lower end 36 of the support leg 34 is moved toward the central axis 24 (to the right in FIG. 4) and the support leg 34 pivots about the first pivot axis 43 in a first direction (counterclockwise in FIG. 4). Similarly, though not shown, a shortening of the first turnbuckle 102 draws the lower end 36 of the leg 34 away from the central axis 24 (to the left in FIG. 4) and pivots the leg 34 about the first pivot axis 43 in an opposite direction (clockwise in FIG. 4). Such movement of the leg 34 results in rotation of the entire frame 16, including the first and second frame portions 32, 52 and the support post 76, about the first pivot axis 43.

The stand 10 also includes (FIGS. 3 and 4) means 112 for moving the second portion 52 of the frame 16 relative to the first portion 32 of the frame 16 about the second pivot axis 50. While various suitable arrangements could be employed, such means 112 includes a second turnbuckle or retractable link 114 extending between the first and second frame portions 32, 52.

Similar to the construction of the first turnbuckle 102, the second turnbuckle 114 includes (FIG. 3) a third threaded stem 116 that is connected to the upper end 38 of the leg 34 and a fourth threaded stem 118 connected to the pivot bar 62. The third stem 116 is connected to the leg 34 by a swivel connection 120 that is fixed to the leg 34 above the first pivot axis 43. As shown in FIG. 3, the fourth stem 118 is attached to the pivot bar 62 by a swivel connection 122 fixed to the pivot bar 62 adjacent the end of the pivot bar 62 extending away from the internal shaft 56. The second turnbuckle 114 also includes a second adjustment nut 124 threadedly engaged with the third and fourth stems 116, 118 to extend or shorten the overall length of the second turnbuckle 114 in a manner like that used to extend or shorten the first turnbuckle 102 in order to positively move the second frame portion 52 relative to the first frame portion 32 in a controlled manner.

As shown in FIG. 3, the second turnbuckle 114 can be adjusted to rotate the second portion 52 of the frame 16 about the second pivot axis 50 relative to the first portion 32 of the frame 16. Extending the second turnbuckle 114 moves the pivot bar 62 (counterclockwise in FIG. 3) and, due to the rigid connection between the pivot bar 62, internal shaft 56, leg 64, and the support post 76, extending the second turnbuckle 114 moves the pivot bar 62, internal shaft 56, support post 76 and leg 64 about the second pivot axis 50 (counterclockwise in FIG. 3) relative to the first frame portion 32. Similarly, retracting the second turnbuckle 114 rotates the second frame portion 52 in the opposite direction (clockwise in FIG. 3).

Because the first and second adjustment means 90, 112 for adjusting the position of the frame 16 provide independently operable turnbuckles 102, 114, the first and second adjustment means 90, 112 thus also provide means for moving the frame 16 about the first pivot axis 43 independently of the position of the second portion 52 of the frame 16 relative to the first portion 32 of the frame 16. The adjustment means 90, 112 also provide means for moving the second portion 52 of the frame 16 relative to the first portion 32 of the frame 16 about the second pivot axis 50 independent of the relative positions of the frame 16 and base 14.

Because the second portion 52 of the frame 16 is moveable relative to the first portion 32 of the frame 16 about the second pivot axis 50, and because the entire frame 16 is rotatable about the first pivot axis 43, the tree 12 supported by the frame 16 can be adjusted into a generally upright position. The second portion 52 of the frame 16 can be moved in a first plane to compensate for any misalignment in the first plane of the bore drilled in the tree trunk. Also, the entire frame 16 can be moved in a second plane to compensate for a misalignment of the bore in the tree trunk in the second plane. By adjusting the frame components about the first and second pivot axes 43, 50, the tree 12 thus can be supported in an upright and stable position. Once properly positioned by adjustment of the first and second turnbuckles 102, 114, the frame 16, and the tree 12 supported thereby, is also maintained in the proper position relative to the base 14 by the first and second turnbuckles 102, 114.

The provision of a base 14 supporting an adjustable frame 16 adapted to support a tree and adjustment means 90, 112 for adjusting the position of the frame 16 without holding the tree provides advantage by affording adjustment by a single person of the position of the tree. Once the tree 12 is mounted on the frame 16, the load on the frame 16 need not be supported by another structure or by another person while the frame 16 is adjusted. Rather, a single person can extend and/or retract the links 102, 114 to positively move the tree 12 into an upright position in a controlled manner without having to hold the tree 12 or otherwise remove or lessen the load on the frame 16 during adjustment of the frame.

The stand 10 also includes (FIGS. 1–4) stop means 140 for limiting pivotal movement of the frame 16 relative to the base 14 about the first pivot axis 43 and for limiting movement of the second portion 52 of the frame 16 relative to the first portion 32 of the frame 16 about the second pivot axis 50. While various suitable constructions for the stop means 140 could be employed, in the illustrated embodiment, the stop means 140 includes the stop plates 30 fixed to the support plates 28. The stop plates 30 prevent rotation of the support leg 34 about the first pivot axis 43 because the lower end 36 of the support leg 34 extends between the stop plates 30.

The stop means 140 also includes means for limiting pivotal movement of the second frame portion 52 relative to the first frame portion 32 about the second pivot axis 50. In particular, the stop means 140 also includes (FIG. 3) a stop member 142 which is rigidly fixed to, and which extends from, the first end 44 of the external tube 42, and which extends into a cut-out portion 144 of the pivot bar 62. The cut-out portion 144 of the pivot bar 62 is defined by a pair of ears 146 extending from the end of pivot bar 62 adjacent the first ends 58, 44 of the internal shaft and external tube 56, 42. One of the ears 146 engages the stop member 142 when the second support portion 52 rotates relative to the first frame portion 32 to a predetermined extent in either direction. The stop means 140 thus prevents a possible over-rotation of either the entire frame 16 about the second pivot axis 50 or of the second frame portion 52 about the first pivot axis 43 in the event one of the turnbuckles 102, 114 becomes uncoupled.

The stand 10 also includes (FIGS. 1 and 2) a watering bowl support stand 170 that is fixed to the base 14. The watering bowl support stand 170 includes a bowl support leg 172 extending upwardly along a vertical axis 173 from the base bar 18. The watering bowl support stand 170 also includes a watering bowl support arm 174 that extends from the bowl support leg 172 to a position generally below the support post 76. The watering bowl support arm 174 is adapted to hold a watering bowl 176 under the second portion 52 of the frame 16 so that the watering bowl 176 surrounds the support post 76. As shown in FIG. 4, a side of the bowl 176 is held below, and extends upwardly into, the inverted U-shaped space defined by the leg 34, the external tube 42 and the first portion 68 of the L-shaped leg 64. This positioning of the watering bowl 176 by the stand 170 affords adjustment of the position of the frame portions 32, 52 about the pivot axes 43, 50 without moving the watering bowl 176.

The watering bowl support arm 174 includes a slide fitting 178 that slidably engages the bowl support leg 172 to afford repositioning of the watering bowl support arm 174 along the watering bowl support leg 172. The slide fitting 178 also has a set screw 180 for fixing the watering bowl support arm 174 in position. Thus, the watering bowl support stand 170 provides an adjustable watering bowl support that can be moved relative to the base 14 and the frame 16 along vertical axis 173 independent of the position of the frame 16.

The provision of such a watering bowl stand 170 moveable independently of the position of the frame 16 provides advantage by affording adjustment of the frame 16 to place the tree 12 in an upright position while also maintaining a relatively level or horizontal orientation of the watering bowl. Also, the moveable bowl support stand 170 can be used to lower the watering bowl 170 away from the L-shaped leg 64 and support post 76 before removing the tree 12 from the stand, thus allowing the emptying of the water bowl 176 before possibly tipping the stand 10 during the removal of the tree 12. Another advantage provided by a watering bowl support 170 that extends under an adjustable and generally cantilevered frame 16 for supporting the tree 12 is that the tree trunk can be supported from below and held in the interior of the watering bowl 176 while the mechanisms for moving or adjusting the position of the frame 16 are located remotely of the water in the bowl 176. Such an arrangement is desirable because of the reduced chances of possible corrosion of the adjustable mechanisms and moveable connections that can be caused by leaking or spilled water.

Figure 6:
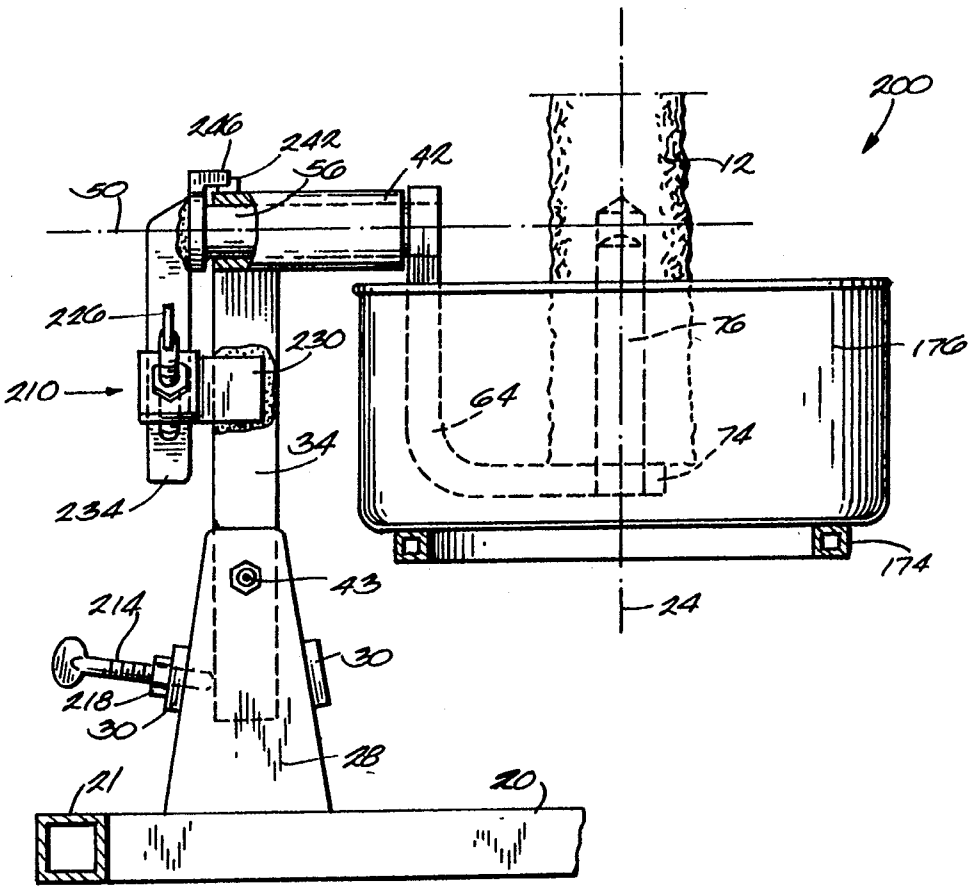
FIG. 6 is an elevational view, partially broken away for illustration, of the stand shown in FIG. 5.
Figure 5:
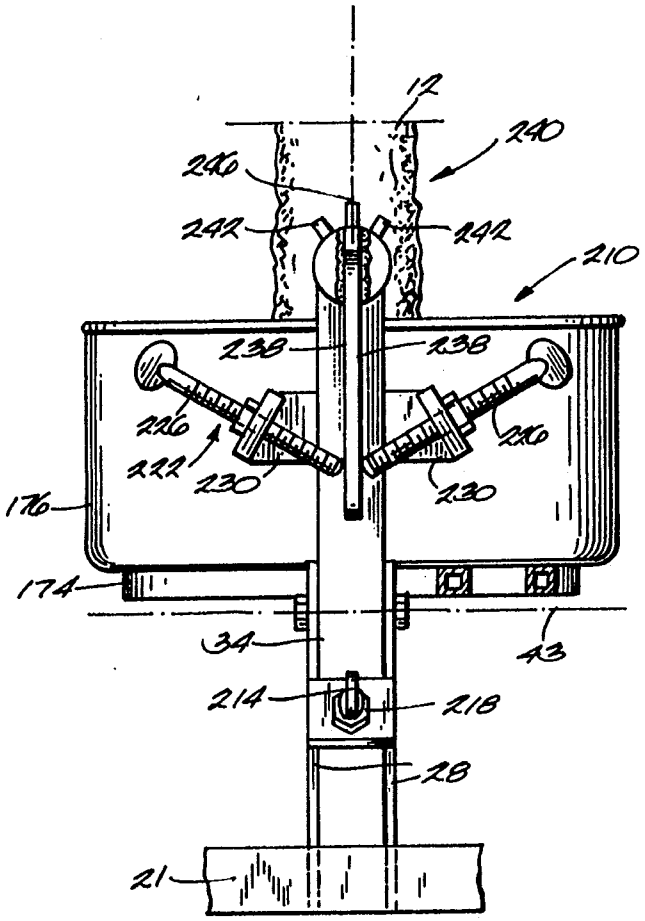
FIG. 5 is an elevational view similar to FIG. 3 illustrating a stand which is a first alternative embodiment of the invention.

FIGS. 5 and 6 illustrate a tree stand 200 which is a first alternative embodiment of the tree stand 10. The tree stand 200 is substantially identical in construction to the tree stand 10, and common reference numerals are used to identify common features. The tree stand 200 includes adjustment means 210 for moving the frame 16 relative to the base 14 without holding the tree 12. The adjustment means 210 includes a first adjustment screw 214 that extends through, and that is threadedly engaged with, the stop plate 30 located away from the central axis 24. Preferably, the adjustment screw 214 has thereon a locking nut 218 to fix the adjustment screw 214 and first portion 32 of the frame 16, in position after adjustment.

Because of the cantilevered configuration of the second portion 52 of the frame 16 relative to the first pivot axis 43 and because of the weight of the tree 12 supported by the L-shaped leg 64 and support post 76 is approximately centered over the base 14, the frame 16 has a natural tendency to rotate about the first pivot axis 43 toward the center 22 of the base 14 (in a clockwise direction in FIGS. 4 and 6) and the lower end 36 of the leg 34 has a natural tendency to move away from the central axis 24 (to the left in FIG. 6). Accordingly, for the stand 200, the adjustment means 210 requires only the single adjustment screw 214 to afford the positive repositioning of the frame 16 by pivotal movement about the first pivot axis 43 in a controlled manner.

The stand 200 also includes second portion adjustment means 222 for rotating the second portion 52 of the frame 16 relative to the first portion 32 of the frame 16 about the second pivot axis 50. The second portion adjustment means 222 includes (FIG. 5) a pair of adjustment screws 226 that are threadedly engaged with respective angle plates 230. The angle plates 230 are fixed to, and extend in respective lateral directions from, the upper end 38 of the leg 34 from above the first pivot axis 43. The adjustment screws 226 have inwardly extending ends that engage a pivot plate 234 fixed to the internal shaft 56. The pivot plate 234 provides a pair of oppositely facing, generally flat surfaces 238 that are engaged by the ends of the adjustment screws 226 to afford a positive displacement and rotation of the pivot plate 234 about the second pivot axis 50.

The adjustment means 210 and 222 can be used to alter the position of the frame 16 and the tree 12 supported thereon without holding the tree 12 by advancing or retracting the adjustment screws 214 and 226 to move the frame portions 32 and 52 about the pivot axes 43, 50.

The stand 200 also includes stop means 240 for limiting pivotal movement of the second portion 52 of the frame 16 relative to the first portion 32 of the frame 16 about the second pivot axis 50. In particular, the stop means 240 includes a pair of circumferentially spaced-apart stop members 242 fixed to the exterior of the external tube 42. The stop means 240 also includes a stop member 246 which is fixed to the pivot plate 234 and which extends between the pair of stop members 242. The engagement of the stop members 242, 246 limits pivotal movement of the pivot plate 234 and, since all of the components of the second portion 52 of the frame 16 are rigidly connected, therefore the entire second portion 52 of the frame 16, relative to the external tube 42 and relative to the first portion 32 of the frame 16.

Figure 7:
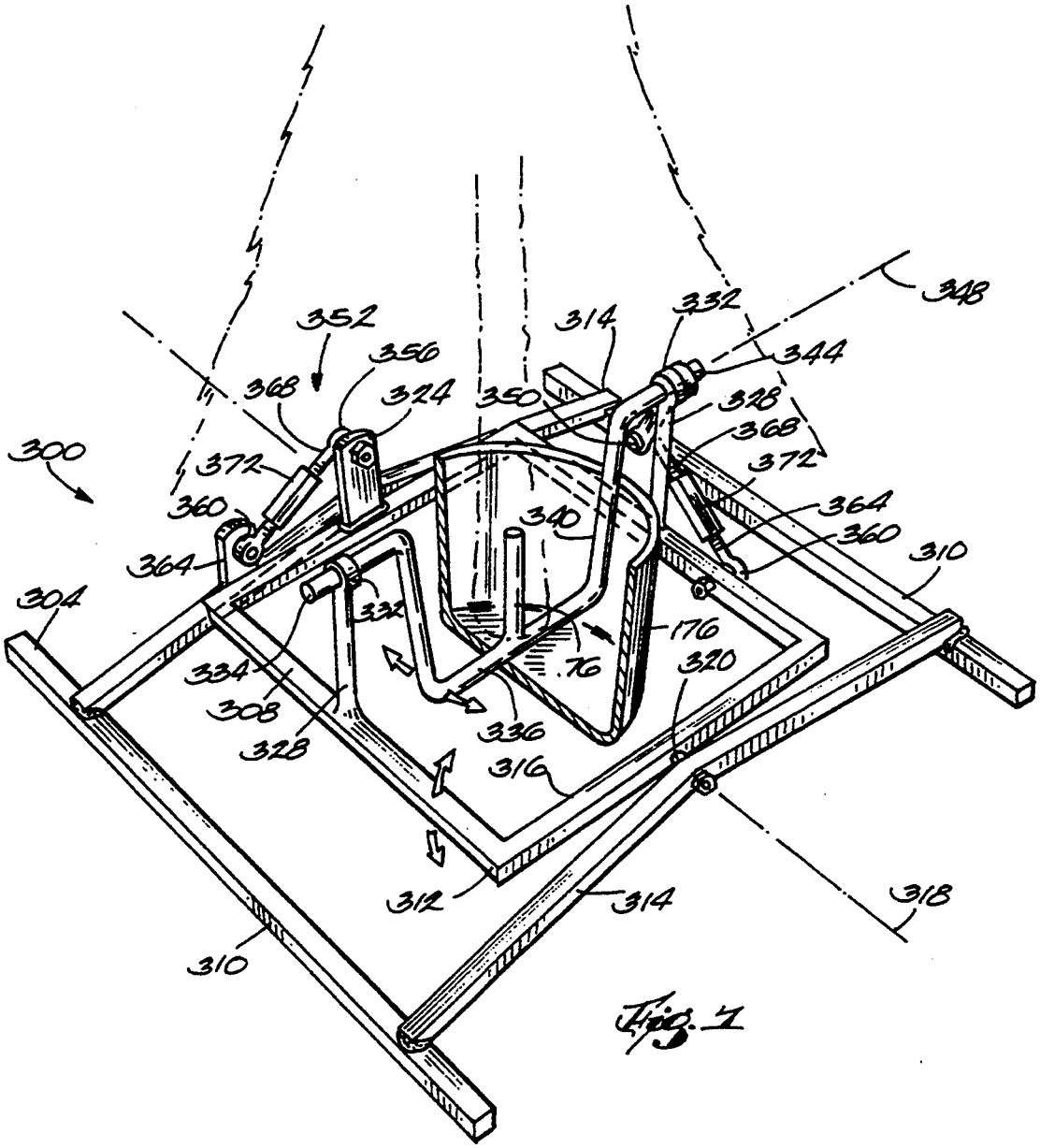
FIG. 7 is a perspective view of a stand which is a second alternative embodiment of the invention.

FIG. 7 illustrates a stand 300 that is a second alternative embodiment of the invention. The tree stand 300 includes a base 304 that is adapted to be supported on a horizontal surface or floor and that provides a stable platform for an adjustable frame 308. The base 304 includes a pair of elongated, generally parallel base members 310 and a pair of angle members 314 extending between and connecting the base members 310. The ends of the angle members 314 are fixed to the base members 310 adjacent the ends of the base members 310. The mid-portions of the angle members 314 are generally parallel and rise to an apex above the base members 310. A first pivot axis 318 passes through the apex of each angle member 314.

The frame 308 includes a first portion 312 that is pivotably supported by the base 304. In particular, the first portion 312 of the frame 308 includes a generally square frame member 316 that is supported on the angle members 314 by a pair of pivot pins 320 (only one shown in FIG. 7). The pivot pins 320 extend along the first pivot axis 318 and afford pivotal movement of the first portion 312 of the frame 308 relative to the base 304 about the first pivot axis 318. For reasons discussed below, the first portion 312 of the frame 308 also includes a first portion arm 324 that extends from the frame member 316 generally vertically from adjacent one of the pivot pins 320. Also, the first portion 312 of the frame 308 includes a pair of second portion support legs 328 extending generally vertically from the frame member 316. The second portion support legs 328 each extend from a side of the frame member 316 that is parallel to the first pivot axis 318, and each has an upper end supporting a tubular portion or an eye 332.

The frame 308 also includes a second portion 336 that is pivotably supported by the first frame portion 312. In particular, the second portion 336 of the frame 308 includes a generally U-shaped member 340 having opposite ends 344 that define a common second pivot axis 348. The second pivot axis 348 is above and is generally perpendicular to the first pivot axis 318. The ends 344 of the U-shaped member 340 are received within a respective eye 332 so that the second portion 336 of the frame 308 is pivotable relative to the first portion 312 of the frame 308 about the second pivot axis 348. The second portion 336 of the frame 308 also includes a second portion arm 350 that is rigidly fixed to one of the opposite ends 344 of the U-shaped member 340 and that extends radially from the second pivot axis 348.

The stand 300 also includes adjustment means 352 for moving the frame 308 relative to the base 304. The adjustment means 352 includes a first turnbuckle 356 extending between the base 304 and the first portion 312 of the frame 308. In particular, the first turnbuckle 356 has a first end or a first stem 360 connected to one of the angle members 314 by means of a swivel connection on a mounting bracket 364 which is fixed to the angle member 314. The first turnbuckle 356 also includes a second stem 368 which is connected to the first portion 312 of the frame 308 through a swivel connection on the first portion arm 324. The first turnbuckle 356 also includes an adjustment nut 372 which can be used to extend or retract the turnbuckle to pivot the first portion 312 of the frame 308 about the first pivot axis 318.

The adjustment means 352 also includes a second turnbuckle 360 that can be extended or retracted to pivot the second portion 336 of the frame 308 relative to the first portion 312 of the frame 308 and relative to the base 304 about the second pivot axis 348. In particular, the second turnbuckle 360 includes a first threaded stem 364 connected to the frame member 316 by means of a first swivel connection. The second turnbuckle 360 also includes a second threaded stem 368 which is connected to the U-shaped member 340 by means of a swivel connection on the second portion arm 350. The second turnbuckle 360 also includes an adjustment nut 372 engaged with the first and second stems 364, 368. The second turnbuckle 360 can be extended or retracted to pivot the second portion 336 of the frame 308 about the second pivot axis 348 independent of the position of the first portion 312 of the frame 308.

The ends 344 of the U-shaped member 340 extend along the second pivot axis 348 a sufficient distance to provide clearance between the legs 328 and the U-shaped member 340 to afford placement of a watering bowl 176 within the frame member 316. When so positioned, the watering bowl 176 can surround the U-shaped member 340. The U-shaped member 340 also includes a supporting post 76 which is adapted to support the trunk of a tree 12 and which, when the stand 300 is used with a watering bowl 176, is surrounded at least in part by the watering bowl 176. Also, the post 76 extends upwardly from the U-shaped member below the second pivot axis 348.

Various features of the invention are set forth in the following claims.

I claim:

1. A stand for supporting a tree having a bore, said stand comprising a base adapted to be supported on a horizontal surface;

a frame supported by said base for pivotal movement about a first generally horizontally extending pivot axis spaced above the horizontal surface, said frame having a first portion and a second portion supported by said first portion for pivotable movement about a second generally horizontally extending pivot axis, said second portion of said frame having a post extending below said second pivot axis and being adapted to be housed by the bore in the tree;

first adjustment means for moving said frame about said first pivot axis relative to said base; and second adjustment means for moving said second portion of said frame about said second pivot axis relative to said first portion of said frame.

2. A stand as set forth in claim 1 wherein said first pivot axis and said second pivot axis are perpendicular.

3. A stand as set forth in claim 1 wherein said first portion of said frame includes a leg having opposite ends, wherein said leg is pivotably connected to said base, and wherein said first portion of said frame supports a tubular member surrounding said second pivot axis.

4. A stand as set forth in claim 3 wherein said second portion of said frame includes a member received by said tubular member.

5. A stand as set forth in claim 1 wherein said first portion of said frame includes a leg having opposite ends and a midportion, and wherein said midportion is pivotably connected to said base.

6. A stand as set forth in claim 5 wherein said first adjustment means includes a retractable link extending between said base and said leg.

7. A stand as set forth in claim 5 wherein said second adjustment means includes a retractable link extending between said leg and said second portion of said frame.

8. A stand as set forth in claim 5 wherein said tree stand further includes a stand fixed to said base and adapted to support thereon a container of water, and wherein said stand is movable along a vertically extending axis independent of the position of the post.

9. A stand for supporting a tree having therein a bore and for supporting a container of water, said stand comprising a base;

a frame supported by said base for pivotal movement about a first generally horizontally extending pivot axis, said frame having a first portion and a second portion supported by said first portion for pivotable movement about a second generally horizontally extending pivot axis, said second portion of said frame having a post extending below said second pivot axis and being adapted to be housed by the bore in the tree; and a stand fixed to said base for supporting the container of water in a position surrounding said post, said stand being movable relative to said base along a vertically extending axis independent of the position of the post.

10. A stand as set forth in claim 9 and further including first adjustment means for moving said frame about said first pivot axis relative to said base and including second adjustment means for moving said second portion of said frame about said second pivot axis relative to said first portion of said frame.

11. A stand as set forth in claim 10 wherein a portion of said post is surrounded by the container and wherein said first adjustment means and said second adjustment means are located outside the container.

12. A stand as set forth in claim 11 wherein said first adjustment means includes a first retractable link extending between said base and said first portion of said frame and wherein said second adjustment means includes a second retractable link extending between said first portion of said frame and said second portion of said frame.

13. A stand as set forth in claim 9 wherein said portion of said post extends below said second pivot axis.

14. A stand as set forth in claim 13 wherein said adjustment member includes a retractable link.

15. A stand for supporting a tree having a bore therein, said stand being adapted to support the tree in a container of water, said stand comprising a base adapted to be supported on a horizontal surface;

a frame supported by said base for pivotal movement about a first generally horizontally extending pivot axis spaced above the horizontal surface, said frame having a first portion and a second portion supported by said first portion for pivotable movement about a second generally horizontally extending pivot axis;

first adjustment means located laterally of the container of water for moving said frame about said first pivot axis relative to said base;

second adjustment means located laterally of the container of water for moving said second portion of said frame about said second pivot axis relative to said first portion of said frame; and a post extending from said frame and being adapted to be housed by the bore in the tree and to support the tree so that at least a portion of the tree extends into surrounded relation to the container of water.

16. A stand as set forth in claim 15 wherein said first pivot axis is located below the second pivot axis.

17. A stand as set forth in claim 15 wherein at least a portion of said post extends below said second pivot axis.

18. A stand as set forth in claim 15 wherein said first pivot axis is perpendicular to said second pivot axis.

19. A stand as set forth in claim 15 wherein said first portion of said frame includes a leg having opposite ends and a midportion, and wherein said midportion is pivotably connected to said base.

20. A stand as set forth in claim 19 wherein said first adjustment means includes a retractable link extending between said base and said leg.

* * * * *